US007303148B2

(12) United States Patent
Campbell et al.

(10) Patent No.: US 7,303,148 B2
(45) Date of Patent: Dec. 4, 2007

(54) LAWN SPRINKLER SYSTEM

(76) Inventors: Tracy L Campbell, 2006 Glenwood Dr., Northfield, NJ (US) 08225; Shannon Campbell, 2006 Glenwood Dr., Northfield, NJ (US) 08225

( * ) Notice: Subject to any disclaimer, the term of this patent is extended or adjusted under 35 U.S.C. 154(b) by 0 days.

(21) Appl. No.: 11/443,263

(22) Filed: May 31, 2006

(65) Prior Publication Data

US 2007/0034714 A1 Feb. 15, 2007

Related U.S. Application Data

(60) Provisional application No. 60/707,542, filed on Aug. 12, 2005.

(51) Int. Cl.
*A62C 31/22* (2006.01)

(52) U.S. Cl. ..... 239/276; 239/73; 239/279

(58) Field of Classification Search ..... 239/73, 239/276, 279, 280

See application file for complete search history.

(56) References Cited

U.S. PATENT DOCUMENTS

| | | | |
|---|---|---|---|
| 2,484,794 | A | 10/1949 | Reuter |
| 2,534,016 | A | 12/1950 | Grelson |
| 2,535,723 | A | 12/1950 | Coombs |
| 2,746,792 | A | 5/1956 | Hough |
| 2,903,190 | A | 9/1959 | Le Deit |
| 3,633,826 | A | 1/1972 | Baker |
| 3,750,956 | A | 8/1973 | Mastman |
| 3,994,441 | A | 11/1976 | Testa |
| 4,087,049 | A | 5/1978 | Traina |
| 4,582,257 | A | 4/1986 | Siegler |
| D284,785 | S | 7/1986 | Lemkin et al. |
| 4,955,539 | A | 9/1990 | Ruttenberg |

(Continued)

FOREIGN PATENT DOCUMENTS

GB 2403123 12/2004

OTHER PUBLICATIONS

Website, http://www.acehardware.com/product/index.jsp?productId=1278257, "Poly Sprinkler Spike Base," one sheet, printed Jul. 11, 2005.

(Continued)

*Primary Examiner*—Christopher Kim
(74) *Attorney, Agent, or Firm*—Richard C. Litman

(57) ABSTRACT

The lawn sprinkler system utilizes a single impulse type sprinkler head and at least one (preferably a series of) ground anchor receptacle(s) for the single sprinkler head. The ground anchors are permanently placed as desired, with the single sprinkler head and water supply hose being moved from one ground anchor to another to complete the watering task. Each ground anchor is provided with indicators to indicate the stop settings for the impulse sprinkler head when installed at that location. The user installs the sprinkler head with its attached hose in the selected ground anchor, and sets the sprinkler head stops in accordance with the indicators on the ground anchor. When the watering has been accomplished at that location, the water is turned off, the sprinkler head moved to another anchor, its stops are adjusted, and the water turned on to continue the process.

5 Claims, 3 Drawing Sheets

U.S. PATENT DOCUMENTS

| | | | |
|---|---|---|---|
| 5,020,722 | A | 6/1991 | Wardell |
| 5,031,838 | A | 7/1991 | Vydrzal |
| 5,337,993 | A | 8/1994 | Hersman |
| 5,687,909 | A | 11/1997 | Dean |
| 5,938,121 | A | 8/1999 | Ferguson et al. |
| 6,098,900 | A | 8/2000 | Smith |
| D439,632 | S | 3/2001 | King et al. |
| D440,280 | S | 4/2001 | King et al. |
| D466,972 | S | 12/2002 | Clivio |
| D497,973 | S | 11/2004 | Schapper |
| 2002/0074428 | A1 | 6/2002 | Djordjevic |
| 2004/0089738 | A1 | 5/2004 | Heren et al. |
| 2005/0011970 | A1 | 1/2005 | Fernandez |

OTHER PUBLICATIONS

Website, http://www.hometownstores.com/detail.aspx?ID=79215&ovchn=GGL&ovcpn=Ace%20Hardware&ovcrn=%22ACE%22%20Brass%20Impulse%20Sprinkler%20/spike&ovtac=CMP, "Brass Impulse Sprinkler/Spike," one sheet, printed Jul. 11, 2005.

Website, http://lawn-and-garden.hardwarestore.com/43-226-sprinklers/zinc-lawn-sprinkler-spike-base-609325.aspx, "Zinc Lawn Sprinkler Spike Base," two sheets, printed Jul. 11, 2005.

LAWN SPRINKLER SYSTEM

CROSS-REFERENCE TO RELATED APPLICATION

This application claims the benefit of U.S. Provisional Patent Application Ser. No. 60/707,542, filed Aug. 12, 2005.

BACKGROUND OF THE INVENTION

1. Field of the Invention

The present invention relates generally to agricultural irrigation systems and devices. More specifically, the present invention comprises a lawn sprinkler system for watering a lawn.

2. Description of the Related Art

A number of different types of lawn and garden sprinklers have been developed for watering and irrigating lawns and similar vegetation. One type that has proven popular for watering relatively large areas is the impulse sprinkler, nearly universally used for watering schoolyards, playing fields, and similar large grassy areas. This is because the impulse sprinkler sprays a long, relatively narrow stream of water outwardly at a relatively great distance, using its impulse mechanism to incrementally change the direction of the spray path to eventually cover the entire area. Other types of sprinklers tend to have smaller coverage areas due to their continuous output over the entire area, rather than directing a stream of water along a relatively narrow path and gradually altering the direction of the stream.

Impulse sprinklers have proven popular for some residential lawns and gardens as well, in some cases. One problem with the use of such impulse type sprinklers is the difficulty in watering an irregularly shaped area, due to the circular area subtended by the spray pattern of such sprinklers. While many impulse sprinklers provide the range to cover a medium size yard, the water pressure must be reduced to avoid covering areas where water is not needed or desired, or wasting water by spraying it into runoff areas. The result is that at least a few such sprinklers are needed to cover the typical irregularly shaped lawn.

In such a situation, such impulse type sprinklers would likely require adjustment to limit the arcuate travel of the spray pattern. While conventional impulse sprinklers are all provided with adjustable stops to limit the spray pattern to an angular segment, it can be difficult to adjust the segment to the desired area. The stops can generally only be set accurately after some experimentation. This limits the practicality of using such impulse type sprinklers as portable devices, where they must be readjusted at each location.

Thus, a lawn sprinkler system solving the aforementioned problems is desired.

SUMMARY OF THE INVENTION

The lawn sprinkler system provides a solution to the above noted problems by providing one or more (preferably a series of) permanently installed ground anchors, which are placed or set as desired in the area to be watered or irrigated. Each anchor includes a receptacle for temporarily and removably affixing an impulse sprinkler head thereto, with the sprinkler head having a compatible fitting depending therefrom for installation in the anchor receptacle. Each receptacle includes an indicator for indicating the desired arcuate spray pattern limits for an impulse sprinkler installed at that point. Such an indicator may comprise arcuately adjustable index tabs on the exposed top of each anchor, or markings applied to the top of the anchor, as desired.

Once the location of the anchors has been decided and the desired spray pattern for a sprinkler installed at each anchor has been determined, the stop limit indicators on the tops of the anchors may be adjusted or marked accordingly. The user of the present sprinkler system then needs only a single impulse sprinkler head with its water inlet and anchor attachment base. A conventional hose is connected to the water inlet, and the sprinkler is installed in the desired anchor. The user then adjusts the stops on the sprinkler head in accordance with the predetermined markings on the anchor, and turns on the water. Once that area has been watered as desired, the water is turned off, the sprinkler is removed from that anchor receptacle, and the sprinkler is installed in a different anchor receptacle. The sprinkler head stops are readjusted for the new limits, as indicated at the new anchor receptacle, and the water is turned beck on to continue the watering operation. The sprinkler system thus allows a user to use only a single impulse sprinkler head to cover a large and/or irregular area, by multiple anchors with predetermined stop index markings for the sprinkler head.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a lawn sprinkler system for use on lawns and similar areas of vegetation that require periodic irrigation or watering. The sprinkler system is particularly well suited for use on residential lawns, but may be incorporated with virtually any area requiring irrigation that does not have a permanently installed water system. The sprinkler system includes at least one ground anchor, and preferably includes a series of ground anchors permanently installed across the area to be watered according to the spray patterns developed by the sprinkler interchangeably installed within the ground anchors. According to the present system, a single sprinkler is sequentially placed within each ground anchor and supplied with water from a conventional portable hose or the like, with the sprinkler being moved sequentially from one ground anchor to the next in order to water the complete area. This results in considerably less expense than an underground irrigation system, and/or a plurality of sprinklers permanently or removably secured to their respective ground anchors.

Figure 1:
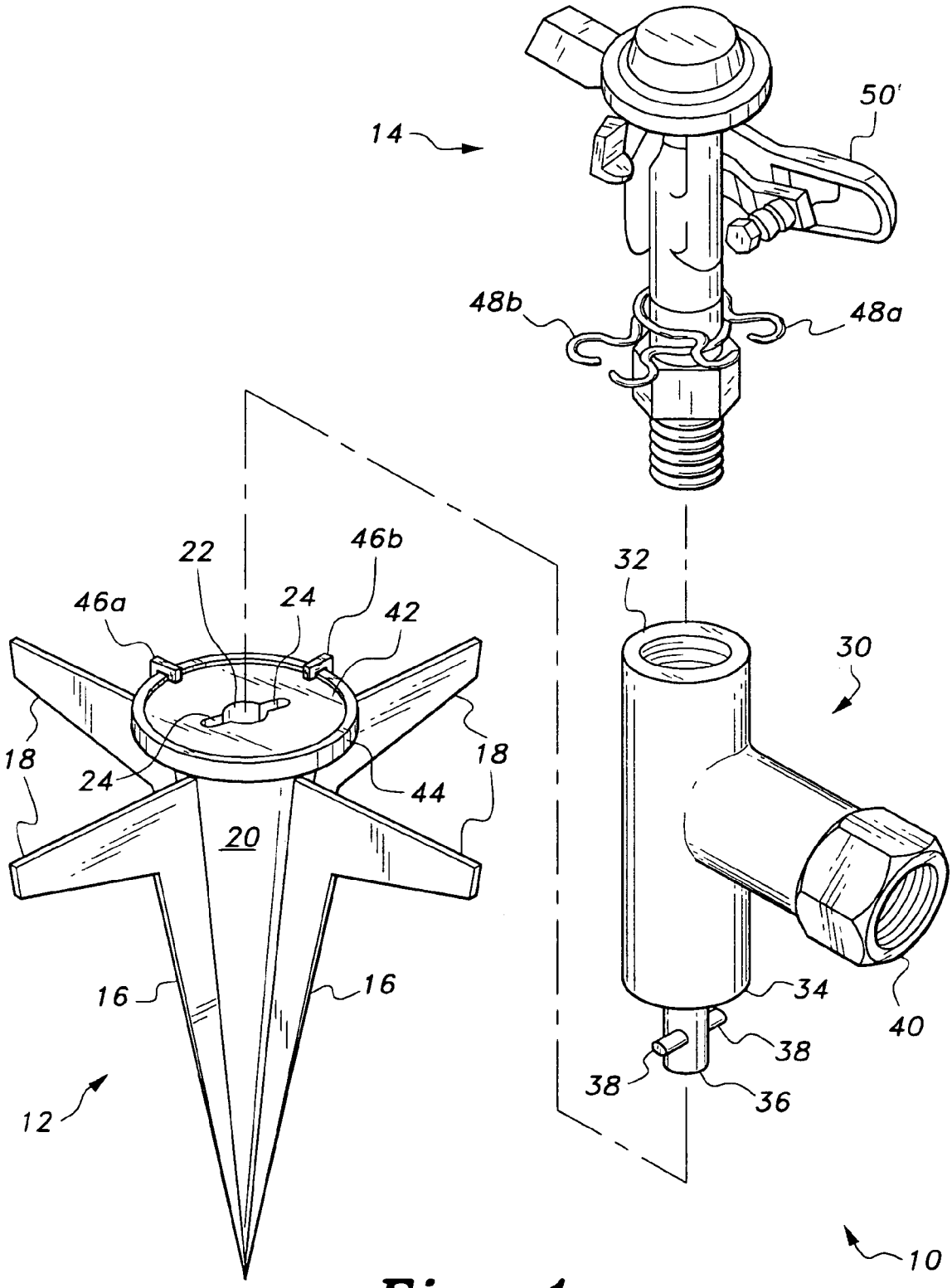
FIG. 1 is an exploded perspective view of a lawn sprinkler system according to the present invention, showing details thereof.

FIG. 1 of the drawings provides an exploded perspective view of the basic components in an embodiment of the lawn sprinkler system 10. As noted above, the sprinkler system 10 utilizes at least one ground anchor 12, with there preferably being a series (i.e., two or more) of ground anchors 12 installed strategically in the ground area to be watered, which are positioned to achieve optimum sprinkler coverage over the entire area and, depending upon the adjustment of the single sprinkler 14, removably and interchangeably installed therein. The ground anchor 12 with its ground penetration blade or blades has a non-circular cross section, as clearly shown in FIG. 1, in order to preclude rotation when installed due to the impulse action of the impulse sprinkler 14 during operation. The anchor 12 includes at least one ground penetration blade 16, and preferably includes a series of such blades. One or more of the blades 16 may have a driving extension 18 extending radially or laterally therefrom, as shown in FIG. 1, or the driving extension(s) may extend from some other portion of the anchor 12, as desired. The purpose of the extension(s) 18 is to provide structure for driving the anchor 12 into the ground. Other means of driving the anchor 12 may be used if the extension(s) 18 is/are not incorporated with the anchor 12, as in the anchor upper portion shown in FIG. 2. The ground anchor(s) 12 is/are preferably formed of a non-corroding material, e.g., corrosion resistant (stainless) steel, or perhaps a less expensive but durable plastic material, in order to withstand the moist ground environment in which they are installed.

The upper portion 20 of the ground anchor 12 includes a sprinkler head attachment receptacle 22 formed therein concentric with the axis of the ground anchor. The receptacle 22 includes at least one (and preferably a pair of opposed) attachment pin slot(s) 24 extending radially therefrom, with a hooked or curved pin detent slot 26 at the base of the pin slot(s) 24, as shown in the cross section view of FIG. 2. Each pin slot 24 and detent slot 26 forms, in combination, a generally J-shaped configuration for removably and interchangeably locking the impulse sprinkler 14 to the ground anchor 12, as explained further below. A detent spring 28 is installed in the base of the receptacle 22 to bear against the base of the sprinkler attachment and push the attachment upwardly into the end of the hooked detent slot 26 to secure the sprinkler 14 to the ground anchor 12. This "bayonet" type fitting or attachment precludes rotation of the sprinkler 14 relative to the ground anchor 12, thereby assuring that the spray pattern of the sprinkler 14 remains constant over the ground area to be covered.

The sprinkler 14 attaches to a sprinkler head base 30. The sprinkler head base 30 is in the form of a pipe tee or the like, and has a T first arm 32 comprising a water outlet and a sprinkler head attachment end adapted to mate with the conventional attachment fitting (e.g., threaded pipe) of the impulse sprinkler head 14. The opposite T second arm 34 is closed, i.e., no water flow passage exists therethrough, with a ground anchor attachment plug or stud 36 extending concentrically therefrom. The attachment plug 36 includes a number of detent engagement pins 38 extending radially therefrom and normal thereto, with the number of pins 38 corresponding to the number of ground anchor receptacle slots 24. The T stem 40 comprises the water inlet for the assembly and is configured for connecting a conventional hose thereto, with the T stem 40 being generally medially disposed between the first and second T arms 32 and 34 and normal thereto.

The sprinkler head base 30, with its attached impulse sprinkler 14, is interchangeably and removably secured to the ground anchor 12 by inserting the attachment plug 36 into the ground anchor receptacle 22 with the detent pins 38 aligned with the slots 24 and pushing down against the resistance of the detent spring 28. The sprinkler head base 30 and its attached sprinkler 14 are turned to cause the detent pins 38 to travel along the hooked detent slots 26, with the spring 28 pushing the plug 36 upwardly to lock the detent pins 38 into the upwardly curved ends of the slots 26. This "bayonet" type fitting precludes rotation of the sprinkler head base 30 (and its attached sprinkler head 14) relative to the ground anchor 12 once installed therein, but allows the sprinkler head base 30 and sprinkler 14 assembly to be easily installed upon and withdrawn from the ground anchor 12 as needed.

Figure 2:
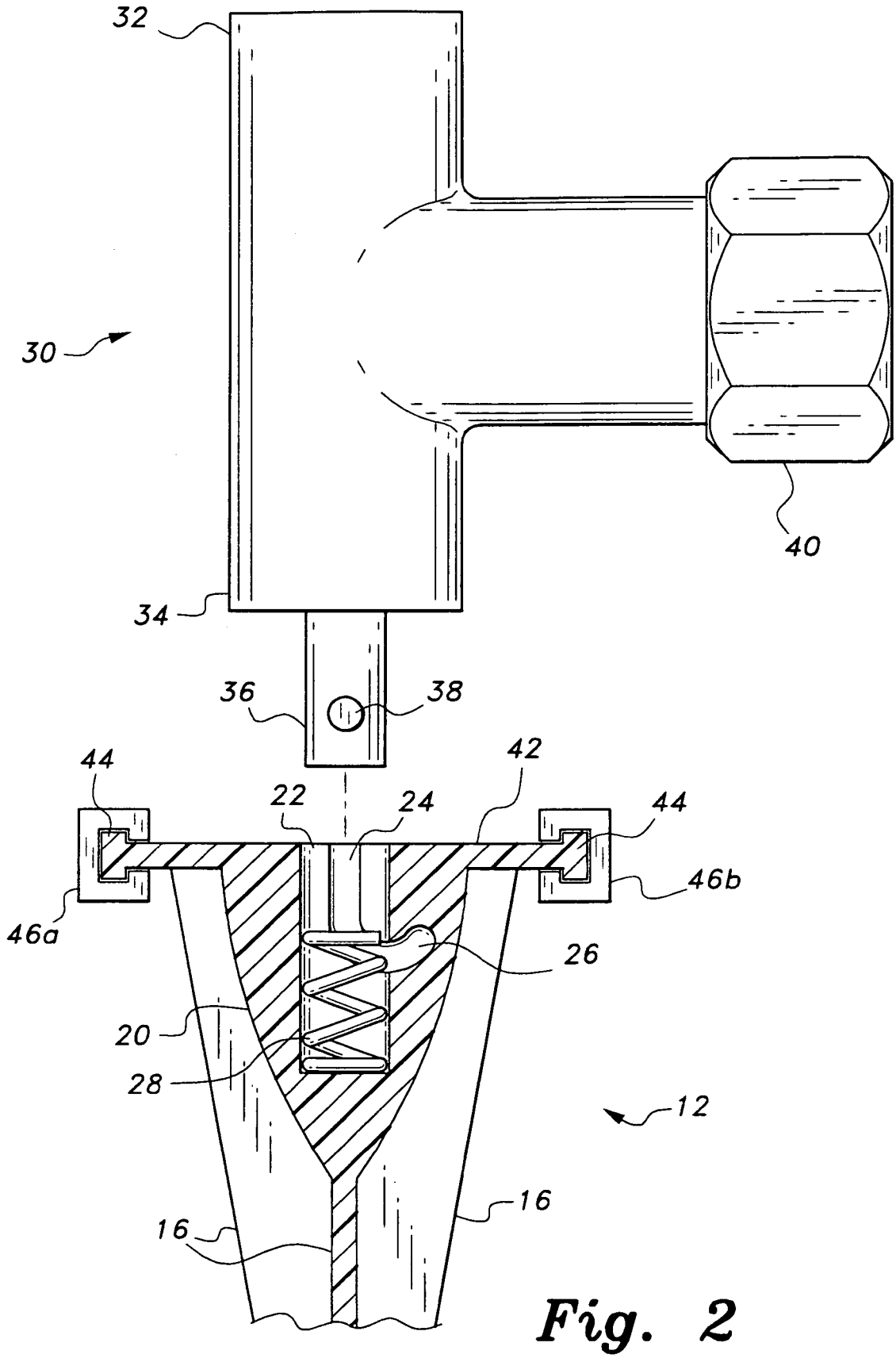
FIG. 2 is a detailed exploded elevation view in partial section of the ground anchor and sprinkler base attachment of the system of the present invention, showing details of their assembly and other features.

The upper portion 20 of the ground anchor 12 includes an index plate 42 thereatop, with the index plate 42 including first and second spray pattern limit indices thereon for indicating the proper stop alignment of the impulse sprinkler 14 when installed upon the ground anchor 12. The spray pattern limit indices may comprise painted or otherwise applied markings atop the index plate 42 or, alternatively, the plate 42 may include adjustably positionable limit indicators, as shown in FIGS. 1 and 2. The index plate of FIGS. 1 and 2 includes a raised peripheral track 44 therearound, with first and second spray pattern limit indicator tabs 46*a* and 46*b* adjustably installed upon the peripheral index plate track 44. Preferably, the indicator tabs 46*a* and 46*b* fit fairly snugly on the track 44 to provide some friction and resistance to inadvertent movement of the tabs 46*a* and 46*b*.

Figure 3:
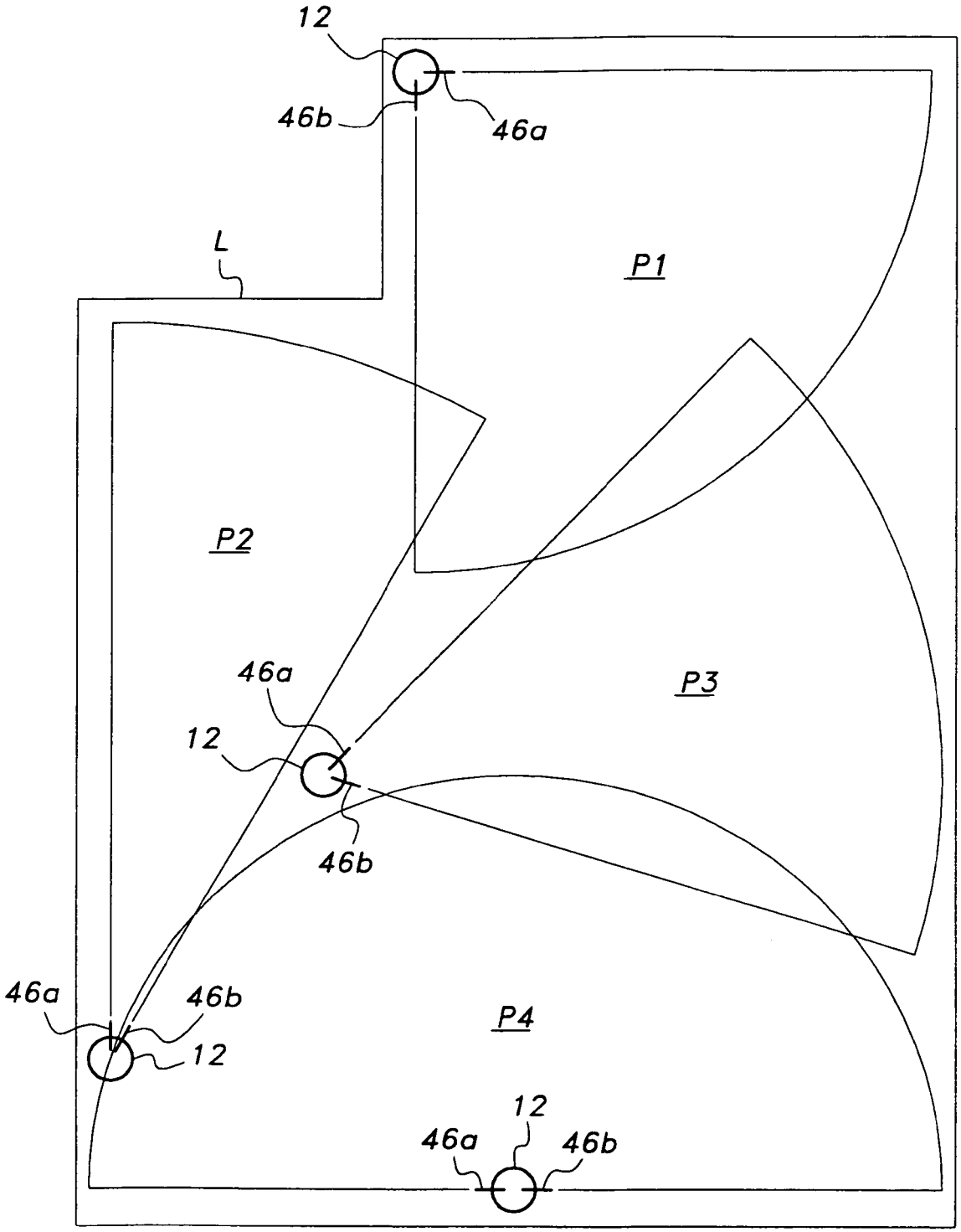
FIG. 3 is a schematic plan view of an exemplary plot of land, showing an exemplary anchor base layout and index settings therefor.

The lawn sprinkler system 10 is used to sequentially water or irrigate a plot of land using only a single impulse sprinkler head 14, as noted further above. FIG. 3 provides a schematic illustration of an exemplary installation of a series of ground anchors 12 and their spray pattern limit indicator tabs 46*a* and 46*b* as installed in a plot of land or lawn L. The impulse sprinkler 14 of FIG. 1 is conventional, with all such sprinklers known to the present inventor operating by means of the same general principles. Such sprinklers 14 include some form of adjustable spray pattern limit contacts, e.g., the first and second contact wires 48*a* and 48*b* of the sprinkler 14 of FIG. 1. In operation, the sprinkler head 14 rotates arcuately back and forth incrementally as it is rotated between the two stops 48*a* and 48*b* due to the engagement or release of the spray arm 50 according to a mechanism as the mechanism contacts either of the two stops 48*a* and 48*b*. The stops 48*a* and 48*b* are aligned as desired by the user of the sprinkler head 14, according to the spray pattern desired.

In the example of FIG. 3, a series of four identical ground anchors 12 have been installed in the plot of land L, with their spray pattern limit tabs 46*a* and 46*b* (or other indices) being set to provide the spray patterns P1 through P4 as indicated. (It will be understood that the definitive edges of the spray patterns P1 through P4 shown in FIG. 3 are hypothetical, and that in reality some overspray will occur, which will cover any areas outside of the marked spray pattern areas of the lawn or land L shown in FIG. 3.) When it is desired that the lawn L be watered, a conventional water hose (not shown) or the like is secured to the water inlet of the T stem 40 of the sprinkler head base 30, and the sprinkler head base with its attached impulse sprinkler 14 is temporarily installed in one of the selected ground anchors 12 by means of the "bayonet" type fitting discussed further above. The start and stop indices 46*a* and 46*b* of the selected anchor 12 are adjusted as desired, if this has not been previously accomplished. The two spray pattern limit stops 48*a* and 48*b* of the sprinkler head 14 are adjusted on the sprinkler head 14 accordingly, to provide the desired spray pattern over that portion of the lawn area L. The water supply is then turned on, and the impulse sprinkler 14 sprays a repeating water pattern in accordance with the previously set stops 48*a* and 48*b*, as is known with such sprinklers.

When the particular spray pattern area has been watered sufficiently, the user may turn off the water, remove the sprinkler head base 30 with its attached hose and attached sprinkler 14 from the ground anchor 12, and replace it within another of the ground anchors 12. Assuming the spray pattern limit tabs or indices 46*a* and 46*b* have been previously adjusted or set on the selected ground anchor 12, the user need only adjust the spray pattern limit stops 48*a* and 48*b* on the impulse sprinkler 14 to match the settings of the tabs or indices 46*a* and 46*b* at that location, and turn on the water to continue the watering or irrigation task. This process is repeated as necessary, with the sprinkler head base 30, its attached hose, and the impulse sprinkler 14 being moved to each successive ground anchor 12 as required until the watering task has been completed.

In conclusion, the lawn sprinkler system enables a person to purchase only a single relatively costly impulse sprinkler head, land use that same sprinkler head to water a relatively large area by sequentially placing the sprinkler head in each of a series of previously installed, permanent ground anchors. The mating attachment components for the sprinkler base and ground anchors allow the user to quickly and easily install and remove the sprinkler head interchangeably in the ground anchors as desired, with the indices of each ground anchor providing an indication for the setting of the spray pattern limit stops of the sprinkler head in each ground anchor location. This results in minimal water waste while assuring that the entire plot of land or lawn receives water, while utilizing only a single sprinkler head. Accordingly, the sprinkler system will be much appreciated by all who have occasion to water or irrigate a medium to large size and/or irregularly shaped plot of lawn or land.

It is to be understood that the present invention is not limited to the embodiment described above, but encompasses any and all embodiments within the scope of the following claims.

We claim:

1. A lawn sprinkler system, comprising:

at least one ground anchor, each said ground anchor having:

at least one ground penetration blade having a non-circular cross section for precluding rotation when installed in the ground;

an upper portion having an index plate atop the blade; and first and second spray pattern limit indices disposed upon the index plate;

wherein said index plate has a peripheral track, said first and second spray pattern limit indices comprising a first tab and a second tab adjustably secured to the peripheral track; and a single sprinkler head base having;

a water inlet;

a water outlet and sprinkler head attachment end in fluid communication with the water inlet; and a ground anchor attachment extending from said sprinkler head base opposite the water outlet and sprinkler head attachment end, the base being removably attached to the at least one ground anchor.

2. The lawn sprinkler system according to claim 1, wherein:

the upper portion of each said at least one ground anchor has a sprinkler head attachment receptacle formed therein, the receptacle having at least one radially disposed pin slot with a detent slot at the base thereof; and the ground anchor attachment of said sprinkler head base comprises a plug having a detent engagement pin extending therefrom and normal thereto.

3. The lawn sprinkler system according to claim 2, further including a detent spring disposed within the sprinkler head attachment receptacle, the spring urging said detent engagement pin into positive engagement with the detent slot of the sprinkler head attachment receptacle when said sprinkler head base is assembled with each said ground anchor.

4. The lawn sprinkler system according to claim 1, wherein each said ground anchor is formed of non-corroding material.

5. The lawn sprinkler system according to claim 1, further including an impulse sprinkler head attached to and extending from the water outlet and sprinkler head attachment end of said sprinkler head base.

* * * * *